US005400971A

United States Patent [19]

Maugans et al.

[11] Patent Number: 5,400,971

[45] Date of Patent: Mar. 28, 1995

[54] SIDE INJECTED PLURAL COMPONENT SPRAY GUN

[75] Inventors: James R. Maugans, Newport Beach, Calif.; Jeffrey D. Bert, Arvada, Colo.; Michael P. Stebelton, Brea, Calif.

[73] Assignee: Binks Manufacturing Company, Brea, Calif.

[21] Appl. No.: 171,067

[22] Filed: Dec. 20, 1993

[51] Int. Cl.[6] ..... B05B 7/04; B05B 7/08

[52] U.S. Cl. ..... 239/416.1; 239/294; 239/419.3; 239/527; 239/433

[58] Field of Search ..... 239/415, 419.3, 416.1, 239/419, 434, 294, 296, 8, 527, 428, 433

[56] References Cited

U.S. PATENT DOCUMENTS

| | | | |
|---|---|---|---|
| 2,829,006 | 4/1958 | Johansson | 239/415 |
| 3,740,260 | 6/1973 | Winn, Jr. | 239/8 |
| 4,325,513 | 4/1982 | Smith et al. | 239/416.1 |
| 4,426,039 | 1/1984 | Kwok | 239/415 |
| 4,824,017 | 4/1989 | Mansfield | 239/296 |
| 4,854,504 | 8/1989 | Hedger, Jr. et al. | 239/419.3 |
| 5,080,283 | 1/1992 | Kukesh et al. | 239/419.3 |
| 5,303,865 | 4/1994 | Bert | 239/294 |
| 5,307,992 | 5/1994 | Hall et al. | 239/419.3 |

*Primary Examiner*—Andres Kashnikow
*Assistant Examiner*—Christopher G. Trainor
*Attorney, Agent, or Firm*—David O'Reilly

[57] ABSTRACT

A side injection plural component spray gun having one or more injector assemblies mounted for injecting a catalyst into a main component at the most forward position of the spray gun. In one embodiment, the injecting assembly has an injection jet connected to the air path for injecting a catalyst into the air stream just before it exits a port for shaping the main component into a fan shaped pattern. The injection jet is constructed to minimize adverse effects on the air stream for shaping the spray pattern. In a second embodiment, dual injection assemblies inject catalyst for delivery through both shaping air ports on either side of the fan shaped pattern of the main component or allows injection of a third component. These embodiments minimize the build-up of catalyst on the walls and passageways of the spray gun minimizing the need for maintenance of the gun and preventing clogging and corrosion of passageways. The trigger for delivering the main component's air and catalyst is arranged to turn the catalyst on after the air, but before the resin, and off after the resin, but before the air to purge any small amounts of catalyst that might remain in the passageway. This eliminates the need for maintenance of the gun, the corrosion of internal parts, and the possible risk of unexpectedly getting catalysts on people or property, and use of undesirable solvents.

16 Claims, 2 Drawing Sheets

SIDE INJECTED PLURAL COMPONENT SPRAY GUN

FIELD OF THE INVENTION

This invention relates to plural component spray guns and more particularly, relates to side injection of a catalyzing agent into an air stream for mixing with a main component.

BACKGROUND OF THE INVENTION

Plural component spray guns spray two or more components that are mixed together during application. A main component is sprayed from a tip at the center of the nozzle. The base component is shaped into a fan shaped pattern by air flowing from nozzle ports on opposite sides of the main component which are sometimes referred to as "horns". The horns form the main component into a fan shaped pattern to evenly cover a relatively wide area.

In some of these plural component guns, such as the plural component spray gun disclosed and described in U.S. Pat. No. RE 31,163 of Gardner, a catalyzing agent is mixed with atomization air in a mixing chamber before being sprayed from the nozzle. In another spray gun, disclosed and described in U.S. patent application No. 07/557,981, now U.S. Pat. No. 5,303,865, raw catalyst is added to a main component externally by a separate jet near the nozzle without mixing it with air. In the latter plural component spray gun, an injection nozzle injects a catalyst agent into the main component after it is shaped into the fan shaped pattern. It would be advantageous if a catalyst could be added early during the shaping of the fan shaped pattern in order to obtain uniform mixing from top to bottom over the entire width of the fan shaped pattern.

A frequent problem with these plural component guns is clogging of parts after prolonged use and sometimes, early on in use. Components that build up in the passages clog the passages as well as the valves and exit paths. A catalyzing agent, added early at the entrance of assist air for mixing, must pass through the geometry of the gun. As the air atomized catalyst passes through passageways and valves, sharp corners and turns tend to cause the catalyst to "shear out" of the air catalyst stream. Also, according to the boundary layer theory for fluids, there is always a thin layer of static fluid coating the walls of passageways and valves that the mixture passes through. This static fluid has the same or even a larger proportion of atomized catalyst in it as the dynamic fluid and, therefore, catalyst builds up on the walls over a period of time which sometimes is all too short.

The problem with build-up is that the catalysts are typically hazardous to persons and property. When build-up exists inside the gun, it can come out unexpectedly and get on persons or property. This would then require constant attention (maintenance) to insure the gun does not have build-up inside.

It is therefore one object of the present invention to provide a plural component spray gun that reduces chemical build-up in passageways of a plural component spray gun to a minimum.

Another object of the present invention is to provide a plural component spray gun that accomplishes a full mix of catalyzing agent with a base component throughout the entire spray pattern.

Still another object of the present invention is to provide "short path" technology by introducing a catalyzing agent into an air stream as close as possible to the nozzle tip spraying the main component.

Yet another object of the present invention is to introduce a catalyzing agent into the shaping air stream that shapes the main component into a fan shaped pattern.

Still another object of the present invention is to introduce the catalyzing agent into an air stream that shapes the main component at a point near the shaping air exit port.

Yet another object of the present invention is to introduce a catalyzing agent into the shaping air stream through dual injectors on both sides of the main component.

Still another object is to provide a side injector for injecting a catalyst in an air stream without adversely effecting the air flow or disturbing the spray pattern.

Still another object is to provide a side injector for a plural component spray gun that provide a port for catalyst flow verification.

Yet another object of the present invention is to provide a side injector for a plural component spray gun that injects a catalyst after the flow of air and before the main component begins and stops injection before the flow of air stops.

BRIEF DESCRIPTION OF THE INVENTION

The purpose of the present invention is to provide "short path" technology by injecting a catalyst into the air stream at the most forward position of the plural component spray gun to reduce chemical build-up in the passages of the gun to a minimum.

The above purposes are achieved by injecting a catalyst into the air stream downstream from the air release valve. Preferably, the catalyst is injected downstream from the air restrictor that limits the air stream pressure to approximately 10 psi. The preferred point of application is at the nozzle just before the air stream flows out of the port that shapes the main component into a fan shaped pattern. The catalyst is introduced through a port that contains its own valving comprised of a needle and a seat shut-off, and a restriction to meter the catalyst flow. The "short path" technology design is unique because it eliminates the problems of corrosion and degradation of the air valving as well as greatly reducing or eliminating the amount of catalyst build-up inside the plural component spray gun.

The injection of catalyst into the shaping air stream is unique because the air stream for shaping or spreading out the main component into a fan shaped pattern is also used to mix the catalyst into the main stream providing a full mix from top to bottom of spray pattern. The catalyst is introduced through a small diameter tube that projects slightly into the air stream. The relative size of the catalyst tube to the air passage is small enough to prevent any adverse effect to the airflow, which would disturb the spray pattern. The slight projection of the catalyst delivery tube into the air passage allows the catalyst to be easily atomized into the air stream without excessive build-up on the walls of the air cap. This design also serves as a method to back pressuring the catalyst limiting the effects of height changes (i.e., head effects).

The "short path" technology is unique because it prevents build-up problems with conventional spray guns. The problem of build-up is two fold: 1) Causes corrosion of internal parts; 2) Can cause an airflow of build-up catalyst particles that can cause harm to people or property. The invention minimizes risk and maintenance by minimizing build-up with the "short path" technology.

The design incorporates a catalyst side injector assembly mounted on the side of the gun as a "side injector". An additional port on the opposite horn, which would be a duplicate connection of the side injector to the nozzle cap for injection into the shaping air, allows a third component to be connected to the air cap for introduction on the opposite side if desired or to inject catalyst on both sides. The advantage of this invention is that when a catalyst is injected into the air stream for shaping air, to catalyze the main component externally as it leaves the gun, the need for flushing is all but eliminated.

The above and other novel features of the invention will be more fully understood from the following detailed description and the accompanying drawings, in which:

DETAILED DESCRIPTION OF THE INVENTION

Figure 1:
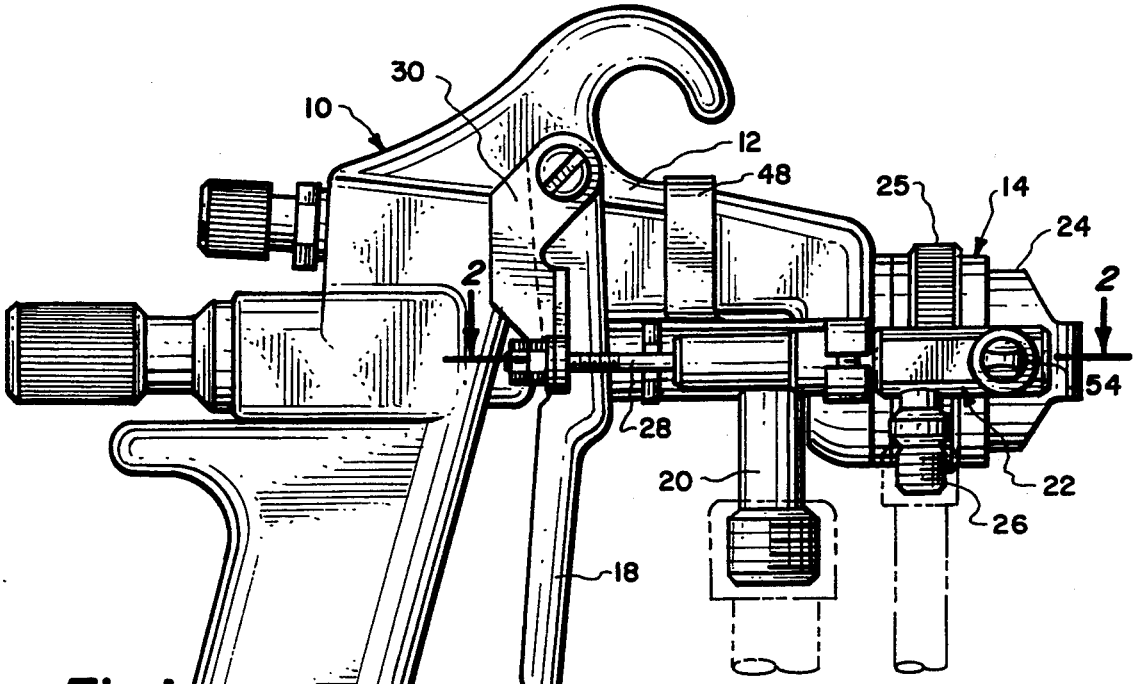
FIG. 1 is a side elevation of one embodiment of a side injected plural component spray gun according to the invention.
Figure 3:
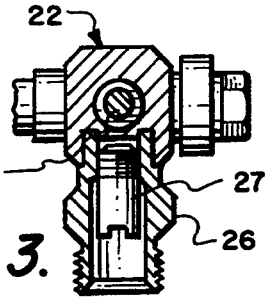
FIG. 3 is a sectional view taken at 3—3 of FIG. 2.

A side injected plural component spray gun 10, shown in FIG. 1, is comprised of a gun body 12 having a nozzle assembly 14, a handle 16 and a trigger 18 for spraying a main component entering through fluid inlet 20 and a catalyst from side injection assembly 22 as will be described in greater detail hereinafter. Air is supplied through air connection 24 to atomize and shape a main component being sprayed from nozzle assembly 14.

In conventional plural component spray guns similar to spray gun 10, a main component such as a resin is released from nozzle 24 and intersects with an atomized catalyst which is atomized internally in gun body 12. These components are released by a pulling on trigger 18 to release a main component introduced through connector 20 and a catalyst introduced from the rear of gun body 12 atomized by air supplied to connector 24. A disadvantage of this system is the flow of catalyst through passageways and valves in gun body 12 can cause a build-up on the walls or passageways and clog the gun. Such spray guns are described in U.S. Pat. No. RE 31,163 to Gardner referred to hereinabove and U.S. Pat. No. 4,618,098 of Hedger, Jr., et al. These types of plural component spray guns can result in a build-up of components in the passageways, they can produce a less than thorough mixing of resin and catalyst and can have the further disadvantage of a high emission of toxic fumes.

To avoid the disadvantages of the prior guns, a side injector assembly 22 is mounted on gun body 12 to inject catalyst into the air stream at the most forward position of the spray gun to minimize or eliminate chemical build-up in the gun passageway and the need to flow through valves in the gun body. The connection of the side injector assembly 22 also provides an air catalyst mix which is more desirable than injecting raw catalyst into the path of the fan shaped pattern of the main component as disclosed and described in U.S. patent application Ser. No. 07/557,981 filed Jul. 26, 1990, now U.S. Pat. No. 5,303,865 of Jeffrey Bert. A difficulty with this system is the distribution of the raw catalyst when it intersects the fan shaped pattern of resin. For this reason, it would be more advantageous if the catalyst could be mixed with the shaping air prior to injection into the fan shaped pattern.

The introduction of catalyst may be accomplished by side injector assembly 22 that injects a catalyst to admix with the air stream at the most forward position possible. Catalyst is introduced to side injecting catalyst assembly 22 through catalyst connector 26. Side injector assembly 22 is comprised of catalyst valve 28 operated by catalyst actuating lever 30 connected to trigger 18. Operation of trigger 18 releases air before actuating lever 30 releases catalyst. The main component or resin is actuated slightly after the catalyst. Thus, the air is on before catalyst is released and the flow of catalyst is shut off before the air. This purges any catalyst from the short path in air cap 24 to the outlet port 34.

Side injector assembly has an injection jet 36 that threads into a threaded hole 38 that communicates with air injection passageway 40 for delivering shaping air through port 34. Injection jet 36 has a small diameter catalyst injection tube 42 that projects slightly into air passage 40 at end 44. Injection tube 42 restricts catalyst in catalyst chamber 46 in injection jet 36 to keep it from bleeding into the cap when shut-off. Also, catalyst injection tube 42 is selected in a size relative to the air passageway 40 so that it is small enough to prevent adverse effects to the airflow which may disturb the spray pattern. The projection of catalyst from injection tube 42 into air passage 40 at 44 allows the catalyst to easily atomize into the air stream at the most forward position adjacent to shaping air port 34. This also prevents any build-up of excessive catalyst on the walls of air cap 24 which is retained on nozzle assembly 14 by retaining ring 25. Injection valve assembly 22 is supported on gun body 18 by valve support bracket 48.

In the normal operation of the plural component spray guns, trigger 18 releases main component or resin from valve 32 with air released through a valve (not shown) into manifold 49 for delivery through shaping ports 34 and 35 and atomizing passageways 50 and 52. In conventional spray guns, catalysts would be introduced for mixture with the air at the rear of gun body 12 and will flow through the varying geometry of the gun which can cause build-up of catalyst in the passageways. With the side injection assembly 22 shown, this build-up is minimized or completely prevented.

The present plural component spray gun 10 is similar to the conventional spray gun in that resin is delivered to nozzle assembly 14 by operation of trigger 18 to release resin delivered through connector 20 for exit through nozzle tip 31. Atomizing or annular air is released in gun body 12 through a valve (not shown) for delivery through manifold 49 into annular passageways 50 and 52 to atomize the resin and into manifold passageway 33 to exit through ports 34 and 35 to shape the pattern of the resin into a fan shaped pattern. In conventional spray guns, catalyst is introduced into the air stream upstream from the air valve. This mixes the catalyst with the air for introduction prior to air adjustment or restriction for flow through the gun body 12.

The disadvantage of this design is the problem of build-up of catalyst in the geometry of the passageways and corrosion and degradation of the air valving in gun body 12.

Figure 2:
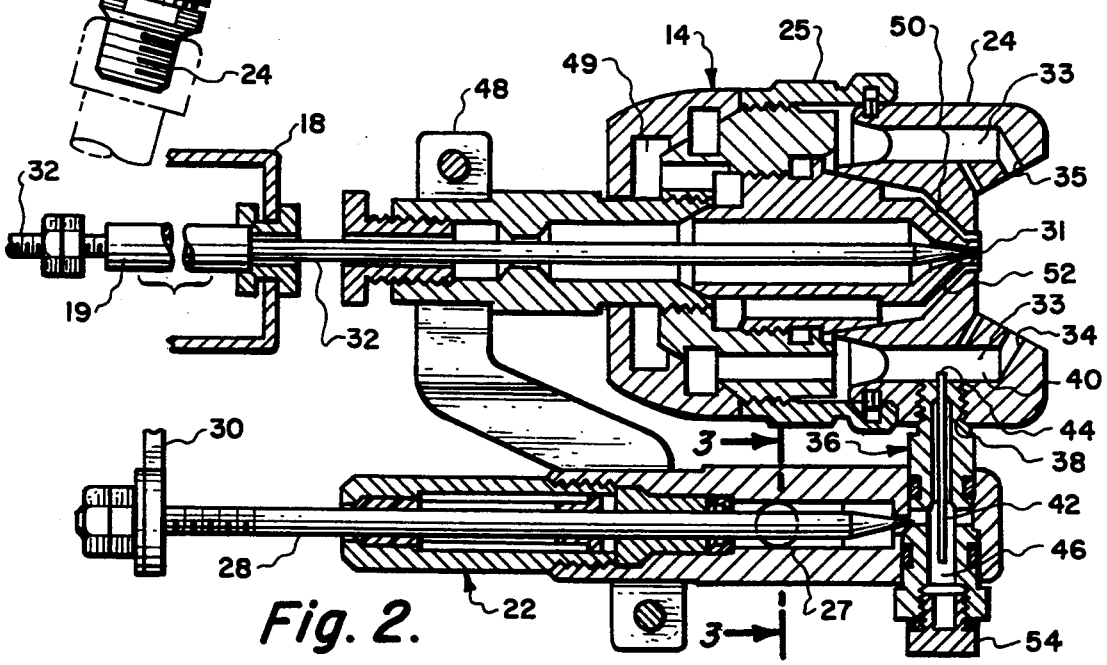
FIG. 2 is a sectional view of the side injected plural component spray gun taken at 2—2 FIG. 1.

In the embodiment shown in FIG. 2, catalyst is introduced for mixing with the air stream at the farthest point forward where the main component or resin is delivered to the nozzle assembly 14. Catalyst, injected through injection jet 36 and connected to air cap 24 exits through shaping air port 34 for mixing into one side of the resin stream accomplishing a full mix from top to bottom of the fan shaped spray pattern. Catalyst delivered through connector 26, is filtered by filter element 27.

Preferably, a knob 54 having flat sides to provide finger grips, is provided on injection jet 36. This allows injection jet to be manually removed from threaded hole 38 for cleaning or replacement. It also allows initial verification and adjustment of the flow rate of catalyst to catalyst valve 28.

The injection of a catalyst into the air stream at the most forward position allows the catalyst to mix with the air before impinging on a main component such as resin. Operation of trigger 18 releases atomizing air from annular passageways 50 and 52 and shaping air from ports 34 and 35 through manifold passageway 33. Continued pressure on trigger 18 then opens catalyst valve 22 releasing catalyst through connection 26 and metering restrictor 27 to injection jet 36. Continued pressure on trigger 18 then releases a main component from nozzle trigger 18. The metered catalyst flows through tube 42 into a manifold passage 33 to mix with shaping air for delivery through port 34. Because the catalyst is mixed with the air before delivery to the resin, and is delivered into the shaping air, a full mix from top to bottom of the spray pattern is accomplished.

The catalyst is introduced through small diameter tube 42 that projects into manifold passageways 33 and 34. The relative size of small diameter tube 42, and the amount it projects into manifold passageways 33 and 34 is arranged so that no adverse effects to the airflow are caused that would disturb the spray pattern. Preferably, the ratio of manifold passageway 33 to the small diameter tube 42 is greater than five to one. The end 44 of small diameter tube 42 extends into manifold passageway 33 a distance that is less than approximately one-fourth the diameter of passageway 33. Injection of catalyst through small diameter tube 42 having the ratios and dimensions specified, has minimum adverse affect on the airflow and will not substantially disturb the spray pattern. Further, the mixture of the catalyst with the airflow at the most forward position, assures an adequate spread of the catalyst over the main component from top to bottom of the spray pattern.

The sequence of operation assures purging of passageways with air when the gun is shut off. That is, air is released first when the trigger is operated and turned off, and last when the trigger is released. The timing of the sequence is controlled by adjusting nuts on the catalyst and main component valves so they are turned on after the air and shut off before the air when trigger 18 is operated as is known in this industry. The air is triggered first then the catalyst from catalyst injector assembly 22, and finally the main component from valve 32. Trigger 18 engages tube 19 which opens a air valve (not shown) in gun body 12 to first introduce air into the passageways and to nozzle 14. Continued pressure on trigger 18 slides actuating lever arm 30 into engagement with adjustment nuts 29, 29' on the end of valve 28 opening the catalyst valves. Subsequently, trigger 18 activates main component valve 32. Thus the sequence is air on, catalyst on, main component on and the reverse when trigger 18 is released.

Figure 4:
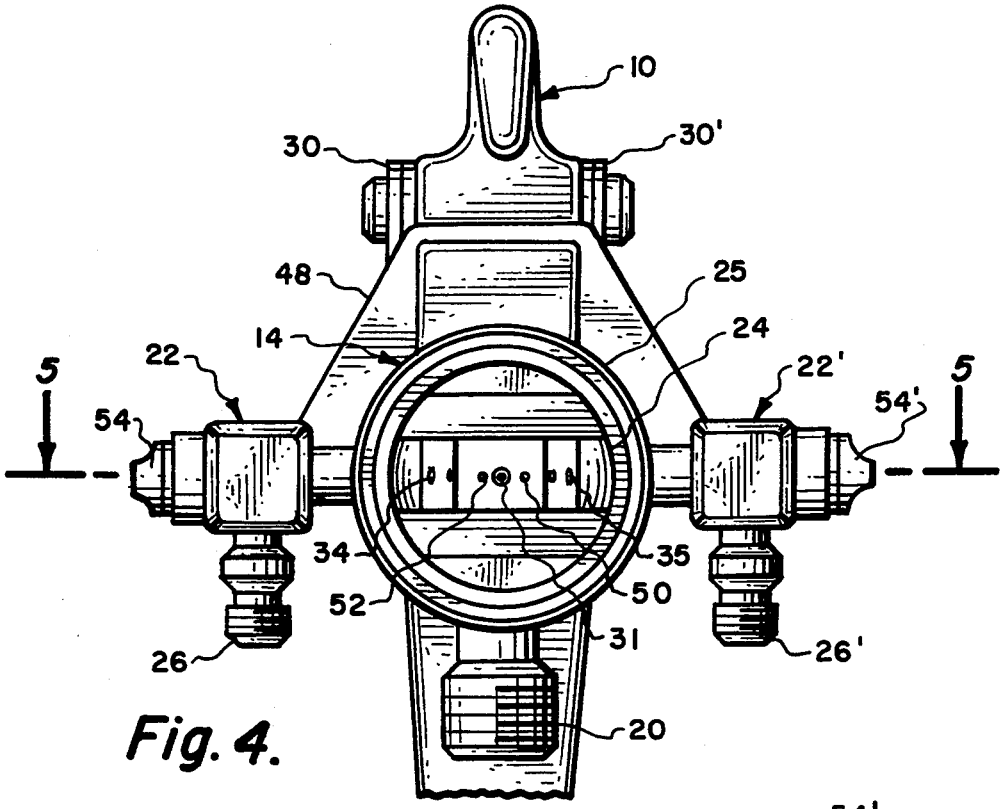
FIG. 4 is a partial view of a second embodiment of a side injected plural component spray gun having dual injectors.
Figure 5:
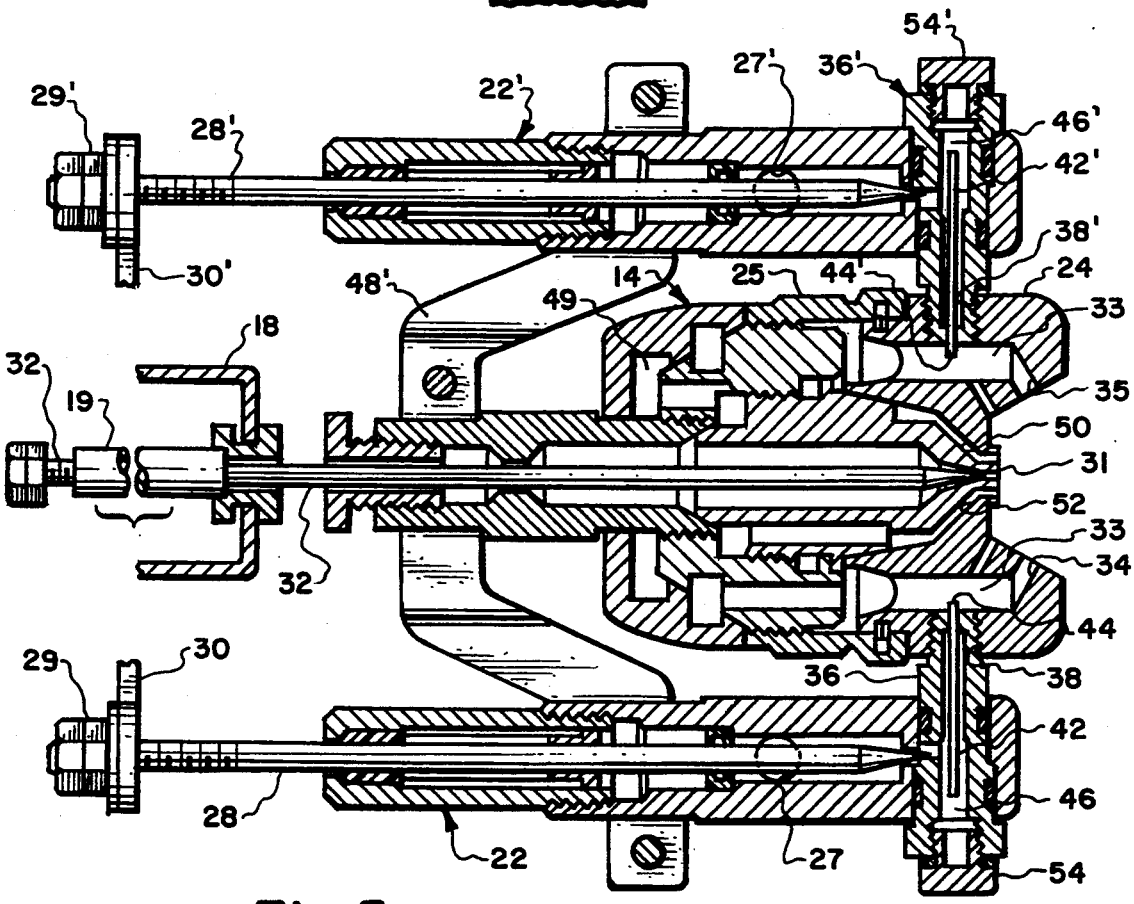
FIG. 5 is a sectional view taken at 5—5 of FIG. 4.

While the preferred embodiment has a single side injector at the most forward position of the plural component spray gun side, a second injector may also be used. A second injector allows selective side injection of catalyst into both sides of shaping air or the addition of a third component. This embodiment is illustrated in FIGS. 4 through 5. However, the same requirements as above must be met. That is, the side injector should inject a catalyst into the airflow pattern such that it does not cause arty affect to the atomization or shape of the main component.

An optional embodiment is shown in FIGS. 4 and 5. In this embodiment a second injection jet assembly 22' is added on the opposite side of the spray gun identical with first injection assembly 22. This allows injection of catalyst on both sides of the main component fan shaped pattern and maintains the "short path" technology of the invention. That is, the second component or catalyst may be injected into both sides of the shaping air at the most forward position of the spray gun. The use of a second injection also provides other options that will be described hereinafter.

A second injection jet assembly to inject catalyst into both sides of the fan shaped pattern is shown in FIGS. 4 and 5. In this embodiment, second injector 22' is mounted on the opposite side of nozzle 24 from the first injector 22. Second injector 22' is connected to trigger through a similar actuating lever 30'. Injector 22' is identical with injector 22 with the exception that it is on the opposite side of the spray gun.

Operation of second injector 22' by trigger 18 through actuating lever arm 30' releases catalyst into injection jet 36' for release into manifold passageway 33 through end or tip 44' of tube 42'. Control of the dual injectors 22 and 25' is adjustable through double adjustment nuts 29 and 29'. Adjustment of double nuts 29 and 29' controls when lever actuating arm 30 opens valves 28 and 28'. The system can be operated with either injector 22 or 22' on, or with both on.

Catalyst is connected through input connector 26' to deliver catalyst to second injector 22'. Connector 26' could be connected to a different source for injection of a third component through second injector assembly 22' if desired.

The use of dual injectors 22 and 22' provide a wide variety of options. In addition to injecting catalyst on both sides of the main component, it also allows the addition of a third component if desired. Another option is control of the volume of catalyst. Thus., the range of catalyst can be varied from injection through a single injection jet assembly 22 or through both injection assemblies 22, 22' for large volume ratios of catalyst to the main component.

Original support bracket 48 is replaced with a support bracket 48' that extends to the opposite side of the gun to support a second injection jet assembly 22'. All the remaining components of the second injection assembly 22' are identical with the injection jet components in injection jet assembly 22. Thus, injection jet 36' is removable as is injection jet 36. This allows calibration of the catalyst delivery or cleaning and replacement of the injection jet. Another advantage of the dual injection jet assembly is that the catalyst is now injected into both sides of the main component fan shaped pattern. This assures even greater distribution and thorough mixing of the catalyst close to nozzle 24 and throughout the entire width of the fan shaped pattern.

The two embodiments described allow the direct injection of catalyst for mixing with the air stream into the shaping air to shape the pattern of the main component. Catalyst is introduced through an injection jet having a small diameter tube that minimizes the adverse effects of catalyst to the airflow which might disturb the fan shaped spray pattern. A second embodiment places another side injector assembly on the opposite side of the gun nozzle assembly to add catalyst to the air stream for delivery through both shaping air ports on both sides of the main component or for addition of a third component. While less desirable because of the additional weight of the gun and more complex geometry, it does provide additional options and a mixture of catalyst on both sides of the main component. In all embodiments, the air is first delivered by operation of the trigger with the catalyst being delivered next and finally the main component. The catalyst is also shut off before the air and after the main component are shut off to allow a short burst of purging air in the passageways. This arrangement minimizes the build-up of catalyst in passageways and eliminates the need for disassembling the gun for maintenance. The air-catalyst-main component sequence insures no uncatalyzed material is dispensed.

This method of introducing catalyst into the resin reduces the possibility of raw catalysts being deflected from the spray pattern which maximizes the use of catalyst and decrease emissions of catalyst fumes. The introduction of the catalyst for mixture with the air at the furthest point forward on the spray gun also eliminates the need for undesirable solvents.

Thus, there has been disclosed a side injection plural component spray gun using unique "short path" technology to introduce catalyst mixture with the air at the furthest point forward in the spray gun. Catalyst is introduced at the nozzle near the ports where shaping air exits. This allows the thorough mixture of catalyst with air and spreads it over the entire fan shaped spray pattern of the main component assuring thorough mixture. In the other embodiments, another side injector and/or horn port is installed to add catalyst to both shaping air ports or a third component into the other shaping air port.

This invention is net to be limited by the embodiment shown in the drawings and described in the description which is given by way of example and not of limitation, but only in accordance with the scope of the appended claims.

What is claimed is:

1. A side injection plural component spray gun comprising;

main fluid component supply means for supplying a main component to a spray nozzle;

air stream supply means for supplying an atomizing air stream and a shaping air stream to said nozzle for atomizing and shaping a spray pattern of said main fluid component;

side injection means for injecting a second fluid component into the path of said air stream at a point that minimizes the length of travel of said second fluid component through passageways in said plural component spray gun;

said side injection means constructed to minimize the disruption of said shaping air stream to prevent any adverse effects on said main fluid component spray pattern;

whereby said second fluid component may be injected into said shaping air stream for uniform external mixing from top to bottom of said main fluid component spray pattern.

2. The spray gun according to claim 1 in which said side injection means is connected to inject said second fluid component into said shaping air stream on one side of said main component spray pattern.

3. The spray gun according to claim 1 in which said side injecting means is connected to inject said second fluid component into said shaping air stream on both sides of said main component spray pattern.

4. The spray gun according to claim 1 in which said side injecting means is connected to inject said second fluid component into said shaping air stream on both sides of said main fluid component and into said atomizing air stream.

5. The spray gun according to claim 1 in which said side injecting means comprises; an injection valve; and an injection jet connected to said valve; said injection jet being connected to a passageway for supplying said shaping air stream to said spray nozzle on said spray gun.

6. The spray gun according to claim 5 in which said injection jet includes a small diameter tube projecting into said air stream passageway; said tube being smaller in diameter than said shaping air stream passageway.

7. The spray gun according to claim 6 in which said small diameter tube projects into said shaping air stream passageway an amount that is less than one-fourth the diameter of said air stream passageway.

8. The spray gun according to claim 6 in which the diameter of said small diameter tube is less than approximately one-fifth the diameter of said air stream passageway.

9. The spray gun according to claim 2 in which said side injecting means comprises; an injection valve; and an injection jet connected to said valve; said injection jet being connected to a passageway for supplying said air shaping stream to said spray nozzle on said spray gun.

10. The spray gun according to claim 9 in which said injection jet includes a small diameter tube projecting into said shaping air stream passageway; said tube being smaller in diameter than said shaping air stream passageway.

11. The spray gun according to claim 10 in which said small, diameter tube projects into said shaping air stream passageway an amount that is less than one-fourth the diameter of said shaping air stream passageway.

12. The spray gun according to claim 11 in which the diameter of said small diameter tube is less than approximately one-fifth the diameter of said shaping air stream passageway.

13. The spray gun according to claim 6 in which said injection jet includes a flow rate verification port; and a removable plug for sealing said flow rate verification port.

14. The spray gun according to claim 13 in which said injection jet has a flat sided knob for manual removing said injection jet for repair or replacement.

15. The spray gun according to claim 1 including a trigger for simultaneously releasing said atomizing and shaping air streams and said main fluid component; an actuating lever connecting said side injection means to said trigger; said actuating lever being connected to turn said second fluid component on after release of said atomizing and shaping air streams and main fluid component and off before said atomizing and shaping air streams and said main fluid component; whereby said shaping air stream momentarily purges the short path of said second fluid component through said gun passageways before shutting off.

16. The spray gun according to claim 6 including a trigger for simultaneously releasing said atomizing and shaping air streams and said main fluid component; an actuating lever connecting said side injection means to said trigger; said actuating lever being connected to turn said second fluid component on after release of said atomizing and shaping air streams and main fluid component and off before said atomizing and shaping air streams and said main fluid component; whereby said shaping air stream momentarily purges the short path of said second fluid component through said gun passageways before shutting off.

* * * * *